United States Patent [19]

Radek

[11] 4,251,855

[45] Feb. 17, 1981

[54] LIGHT CORNICE

[75] Inventor: John R. Radek, Hinsdale, Ill.

[73] Assignee: Ready Metal Manufacturing Company, Chicago, Ill.

[21] Appl. No.: 9,530

[22] Filed: Feb. 5, 1979

[51] Int. Cl.[3] ..... F21S 1/02

[52] U.S. Cl. ..... 362/151; 362/125; 362/432

[58] Field of Search ..... 362/125, 147, 148, 150, 362/151, 404, 432

[56] References Cited

U.S. PATENT DOCUMENTS

| | | | |
|---|---|---|---|
| 2,922,029 | 1/1960 | Eschelbach | 362/151 |
| 2,986,627 | 5/1961 | Marriett | 362/151 |
| 3,865,248 | 2/1975 | Donovan | 362/151 |

*Primary Examiner*—Donald P. Walsh
*Attorney, Agent, or Firm*—Frank H. Marks

[57] ABSTRACT

A light cornice designed for illuminating a wall of a retail store or the like, of knockdown construction for quick and easy erection. Tailored to fit a specific installation, there is a minimum of onsite labor, with little or no waste, and mountable with common hand tools. Consequently, there is great saving in cost. The improved cornice panels have detachable light fixtures adjustably mounted thereon, the panels being adjustably secured to posts adjacent the wall.

14 Claims, 17 Drawing Figures

P
15
15'
17
17'
20
22
22'
25
25a
26
30
32
70
72
7
9

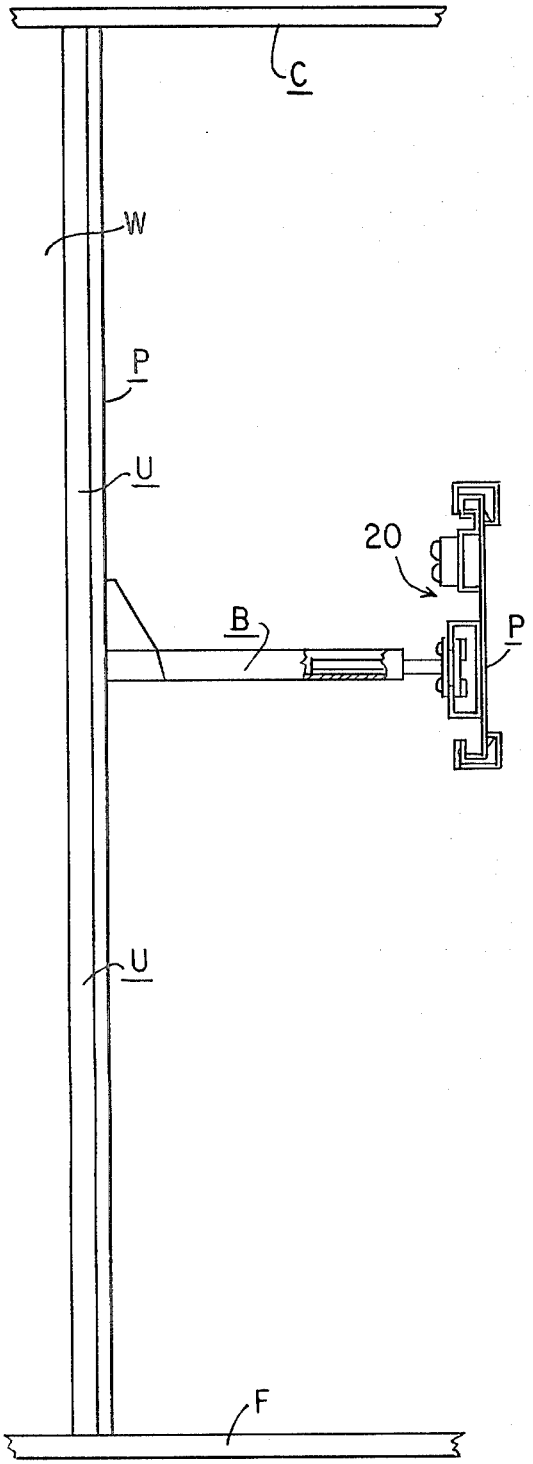
FIG. 11
FIG. 13
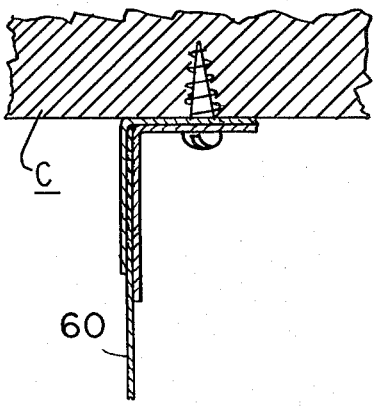
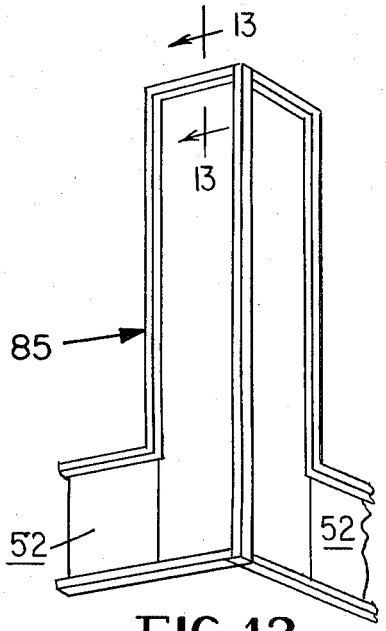
FIG. 12

LIGHT CORNICE

My invention relates generally to "hanging" light panels known in the trade as cornices and intended primarily for use in retail merchandising establishments such as department stores for illuminating a wall, and has to do more particularly with such a construction prefabricated to fit a particular installation as a modular unit for quick, easy and inexpensive setup.

BACKGROUND

Lighting cornices of the general type concerned with my invention have been known and used, as in retail stores. Such equipment has been constructed to a large extent on the individual job at great expense because of the heavy use of on-site labor and wasted material. It has also been difficult and costly to take down and remove such installations.

BRIEF OUTLINE OF INVENTION

A prime object of my invention is to provide a light cornice of the type referred to, prefabricated to fit a particular installation, with parts specially designed for quick and easy setting up with common hand tools. My improved equipment may be erected with a minimum of on-site labor, with little or no waste and substantial reduction of expense. The same may be said with regard to removal and servicing, all of which may be accomplished with minimum labor and cost.

Details of construction making possible the important advantages inherent in my invention will appear as the description proceeds, along with various other advantages apparent to those skilled in the art.

BRIEF DESCRIPTION OF DRAWINGS

Referring now to the drawings forming a part of this specification and illustrating certain perferred embodiments of my invention.

FIG. 2*a* is a fragmentary horizontal section of an alternative juncture means for an outside rectangular corner;

FIG. 2*b* is a fragmentary plan view of an outside obtuse angled corner;

FIG. 11 is a schematic sectional view illustrating generally a cornice/lighting construction embodying my invention in relation to its supporting means;

FIG. 12 is an outside perspective view of an outside corner, illustrating another form of upswing panel arrangement; and FIG. 13 is a fragmentary vertical section substantially along line 13—13 of FIG. 12, showing attachment of an upswing panel to the ceiling,

DETAILED DESCRIPTION

Figure 1:
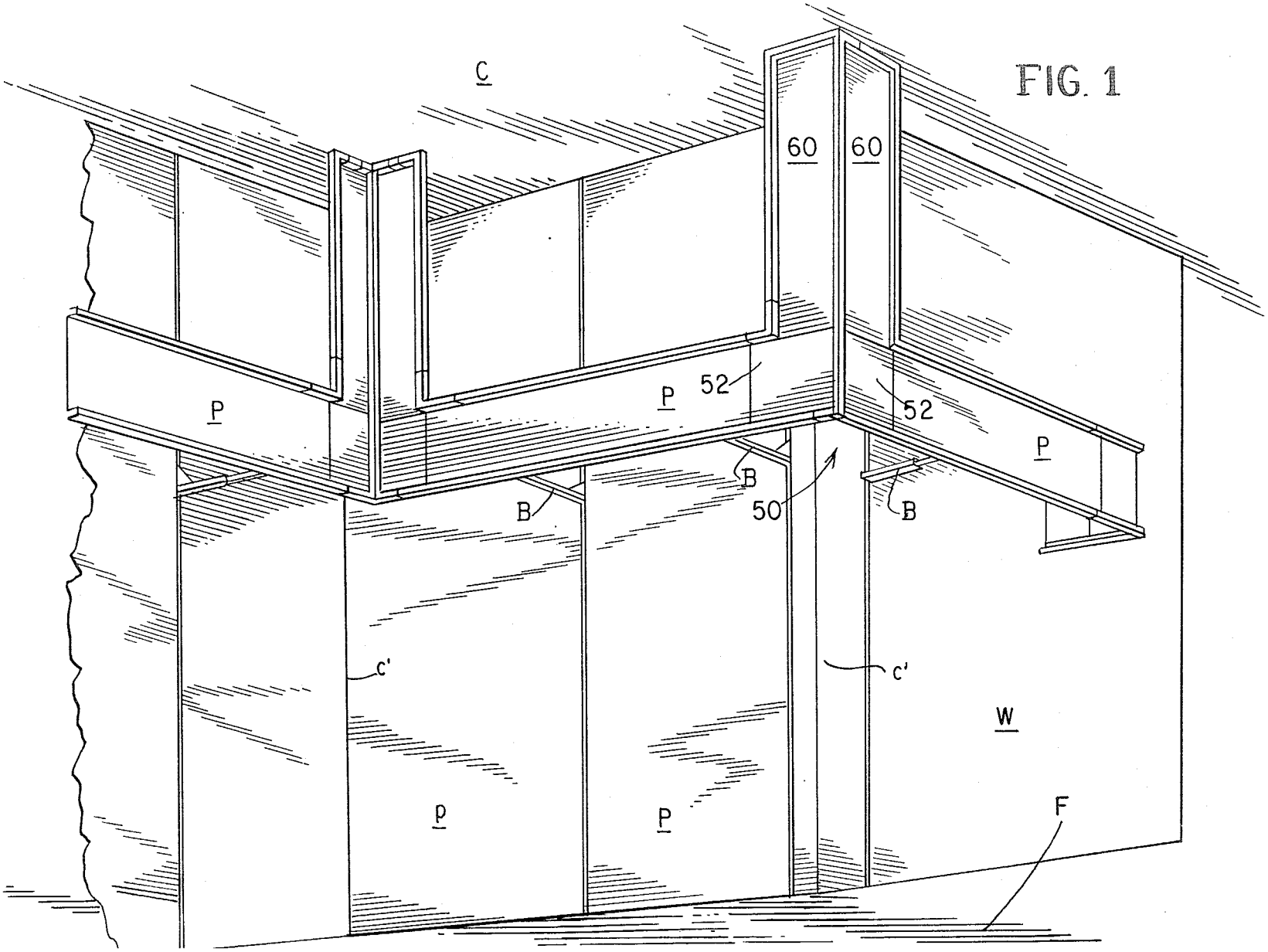
FIG. 1 is a perspective view of a light cornice assembly embodying my invention in complete erected condition to conform to inside and outside corners of a room.

Referring first to FIG. 1, an installation embodying my invention is normally disposed adjacent a permanent wall W of a display room, say, of a retail store, which wall is intended to carry signs or other display material for promoting the sale of merchandise, which wall display is to be illuminated by my improved cornice. Said wall normally extends between floor F and ceiling C and is preferably covered by a finishing surface provided by panels p of a suitable material, eg., "Masonite" or "Sheetrock."

In this instance I show inner and outer corners c and c′, respectively, to illustrate the adaptability of my invention to a variety of room structures.

My improved cornices here seen and to be further described comprise a plurality of contiguous, horizontally extending panels P. (While the specific nature of materials employed is not of the essence of my invention, in general, unless otherwise specified, the most suitable materials for my purposes are metals.) Basically, said cornices, comprising the sheet metal panels P and associated parts, are supported in cantilever fashion by a series of horizontally spaced brackets B attached to spaced uprights U disposed along the wall. (FIG. 11.)

Figure 3A:
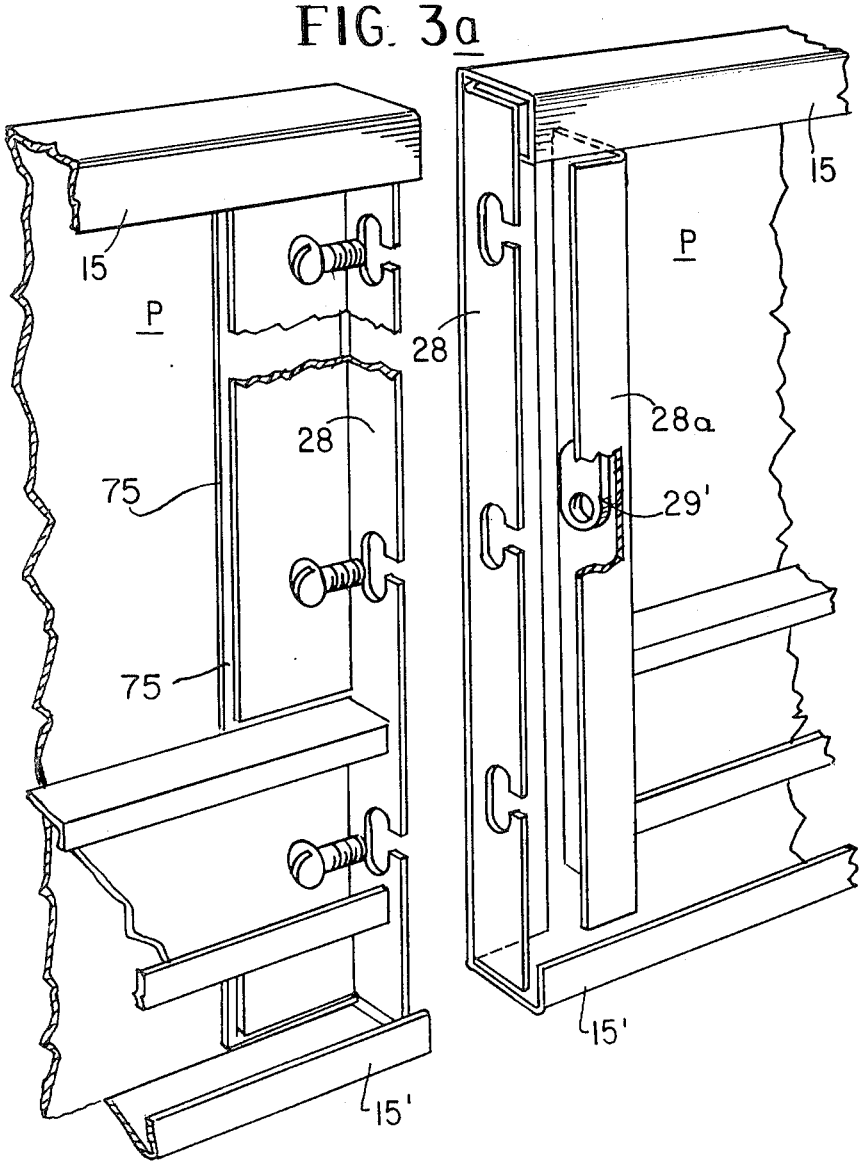
FIG. 3*a* is a fragmentary rear perspective view showing an alternative panel juncture arrangement to that of FIG. 3.
Figures 3, 4, 5:
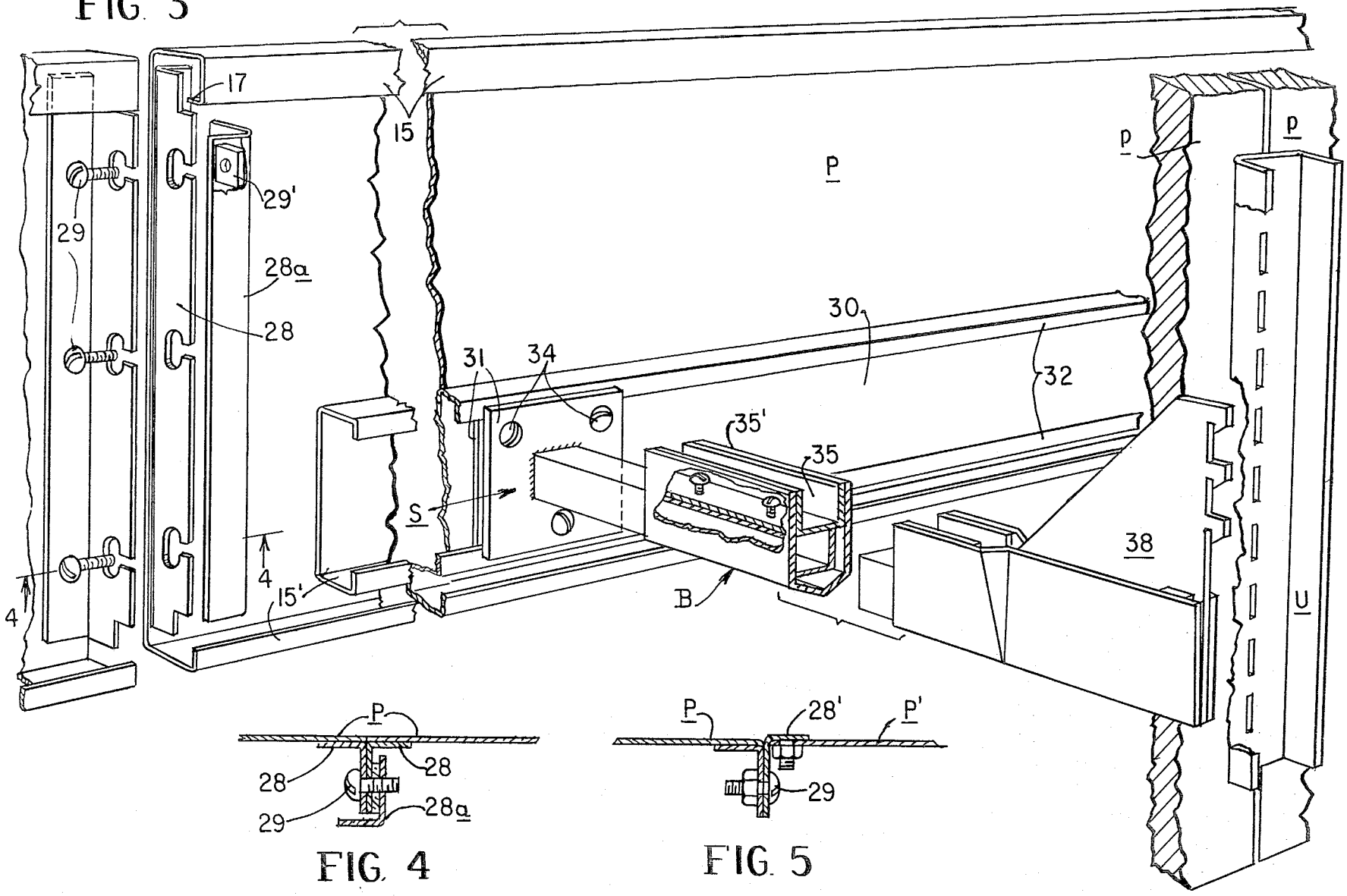
FIG. 3 is a fragmentary exploded rear perspective of a cornice panel with associated support means.
FIG. 4 is a sectional detail taken substantially along line 4—4 of FIG. 3, to show a particular joining means.
FIG. 5 is a sectional view generally similar to FIG. 4, illustrating a modified joining means for a different situation.

Turning to FIG. 3, it will be noted that panels P are preferably of sheet metal with channel portions 15, 15′ formed at the upper and lower edges, each with a free flange 17. At the top said flange 17 provides a hanger for a light panel 20 (FIGS. 6–8), preferably for fluorescent illumination. Said light panel has a U-shaped portion 22 at the top including a free flange 17′ nested within channel portion 15 of panel P and swung into assembled position as seen FIGS. 7 and 8. A suitable baffle 70, say of sheet metal or other reflective material, may be attached as by rods 72 below and behind light panel 20.

Figures 6, 7, 8, 9, 10:
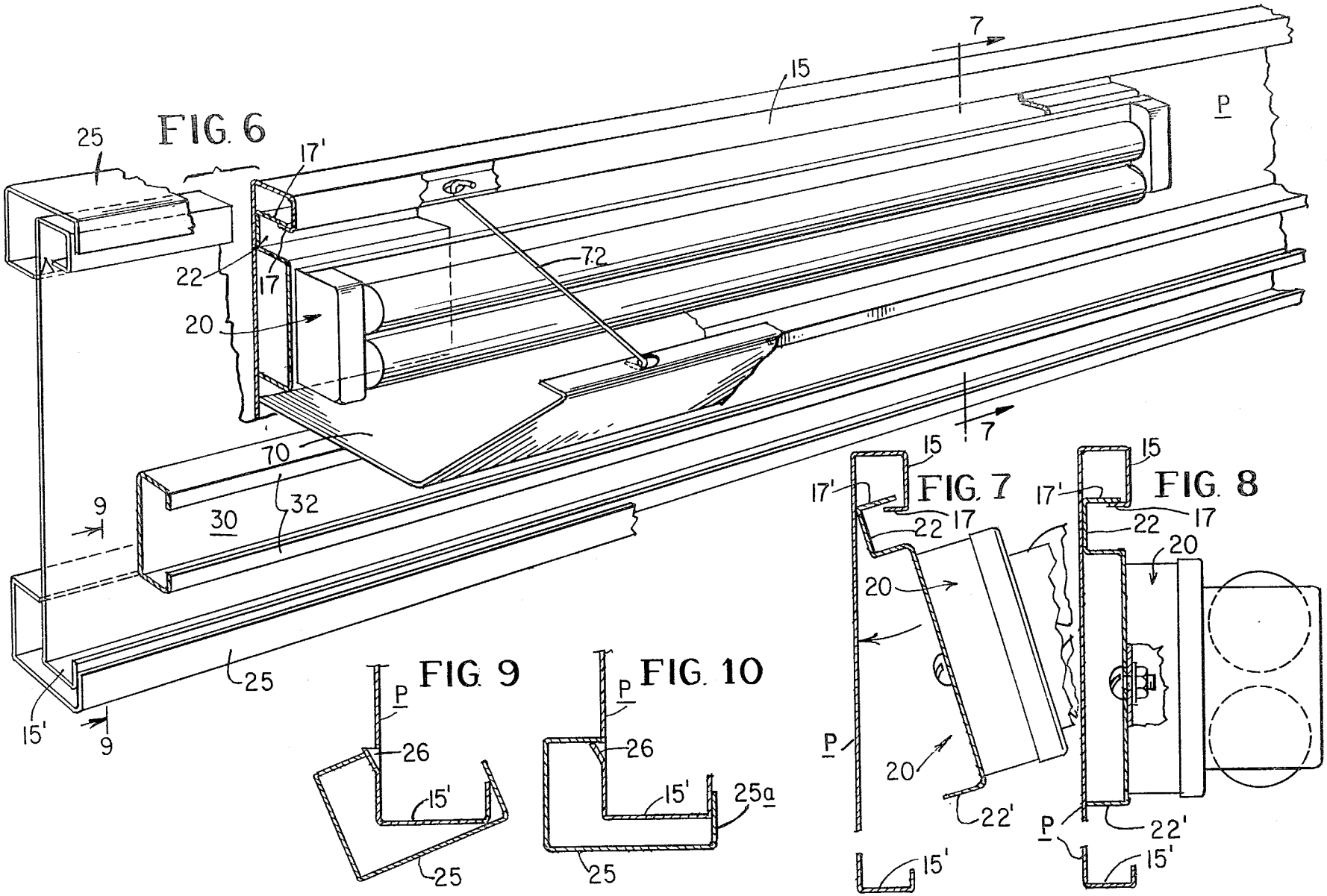
FIG. 6 is a fragmentary rear perspective view showing a cornice assembly, including lighting means.
FIG. 7 is a fragmentary vertical section substantially along line 7—7 of FIG. 6, showing a suitable first step in assembling a lighting device with a cornice panel.
FIG. 8 is a view similar to FIG. 7 with the parts fully assembled.
FIG. 9 is a fragmentary vertical section substantially along line 9—9 of FIG. 6, showing a preliminary stage in assembling a trim molding section with a cornice panel.
FIG. 10 is a view similar to FIG. 9 with the parts fully assembled.

Trim strips 25, 25 of generally similar rectangular cross section are mounted over the top and bottom edges 15, 15′ of panel P (FIGS. 6, 9, 10). Prongs 26 or other suitable retaining elements are struck out of panel P over which trim strip 25 may be snapped for secure attachment. Flange 25*a* is formed at an angle slightly less than 90° so that, when in assembled position, the strip will make a tight grip on the contiguous flange of channel 15′.

Any desired number of panels P may be horizontally disposed in series to form a cornice of any desired length by providing angular splicing bars 28 (FIGS. 3, 4) adjacent their ends, as by spot welding, said bars 28 being slotted to seat screws 29 or the like engageable with weldnuts 29′ or the like carried by an angle bar 28*a*.

In FIG. 5 I show a modified splicing arrangement where a specially cut panel P′ is spliced to a standard panel P to fit a particular space. The construction is considered clear from the drawing.

In another modified arrangement (FIG. 3*a*) for splicing a specially cut short panel to a standard panel P, a double-faced (adhesive on both sides) tape 75 is interposed to retain splice bar 28 (FIGS. 3*a*).

PANEL SUPPORT

To the lower rear face of panel P is secured, as by welding, a channel 30 having opposed coplanar flanges 32, 32 spaced apart a sufficient distance to provide a trackway for a slide bar S formed of a pair of opposed plates 31, 31 secured together as by screws 34. Said slide bar slidingly engages flanges 32, 32 to which said bar may be clamped by said screws 34, permitting longitudinal adjustment along channel 30.

Slide bar S carries a cantilever bracket bar B (FIG. 3) which may comprise a pair of nested channels 35, 35′ relatively slidable for longitudinal adjustability, which channels may be secured in adjusted position relative to each other as by screws.

The inner end of bracket bar B carries a connecting plate 38 having vertically spaced hooks engageable in slots of upright U, which may be a channel. Similar uprights are horizontally spaced along the wall behind wall panels p and adjacent the cracks therebetween, whereby the brackets B extend forwardly from said cracks (FIG. 3) to support the cornice.

Figure 2:
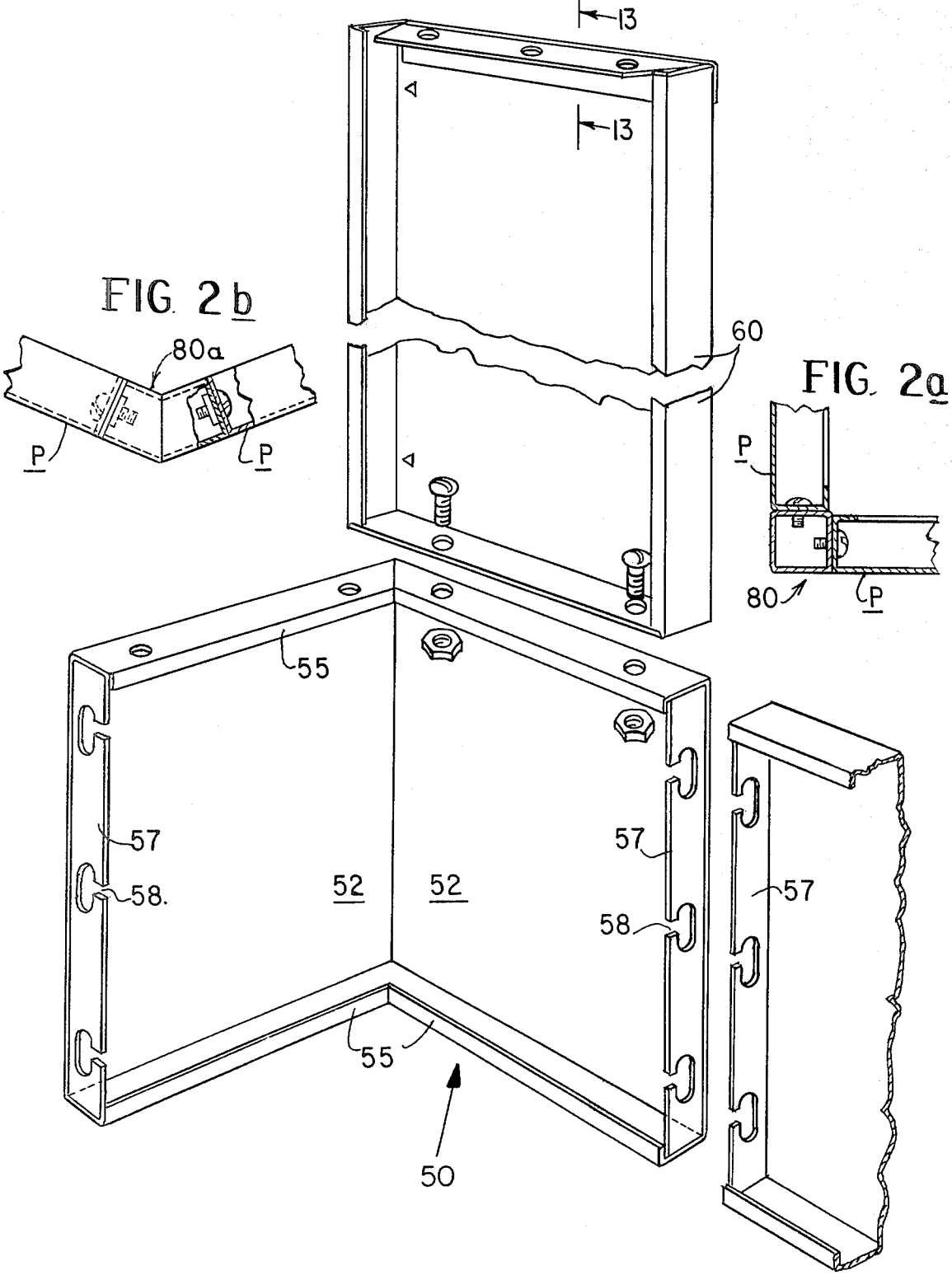
FIG. 2 is an exploded rear perspective of an outside rectangular corner construction.
Figure 2C:
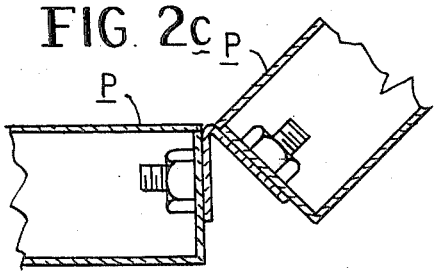
FIG. 2*c* is a similar view of an inside obtuse angled corner.

As seen in FIGS. 1 and 2, whether a cornice embodying my invention extends along an entire wall or only partially thereof, or around a corner of a room (which corner may be 90° or other angle), and either an inside or outside corner, in any event, a corner member 50 is provided for esthetic as well as structural considerations.

Said corner member 50 comprises a pair of plates 52, 52 (FIG. 2) whose edges are welded together or otherwise secured at the corner, or with an intermediate corner member 80, 80*a* of appropriate angular cross section (FIGS. 2*a*, 2*b*). Said corner panels have upper and lower flanges 55, 55 and lateral flanges 57, 57, the latter slotted as at 58 to receive screws for engagement in a nut bar 28*a* (FIGS. 2, 4).

The upper flange 55 may be apertured to receive screws for attachment of an upwardly extending panel 60 I call an upswing, secured at the top to the ceiling (FIGS. 2, 13). Said upswing 60 thus provides not only an esthetic finish to the ensemble but also shares in carrying the load of the cornice in conjunction with bracket bars B.

In a modified arrangement (FIG. 12) a corner panel may be made integral with the upswing as a unitary panel 85, simplifying the construction and further reducing cost of assembly, etc.

CONCLUSION

It will be seen that I have provided an improved light cornice of greatly enhanced simplicity and flexibility, reduced cost and enhanced esthetics, adaptable to a variety of room situations. Embodiments of my invention may be produced at the factory ready for installation with a minimum of on-the-job labor, thus greatly facilitating installation and removal and substantially reducing cost.

Furthermore, installations embodying my invention are stronger and more rugged than arrangements previously known and are capable of a wide variety of installations to fit practically any ordinary room design.

Various changes coming within the spirit of my invention may suggest themselves to those skilled in the art. Hence, I do not wish to be limited to the specific forms shown herein or uses mentioned except to the extent indicated in the appended claims.

I claim:

1. In a knockdown light cornice construction for illuminating a retail store wall or the like, (a) a vertical strut adapted to be fixedly positioned adjacent said wall, (b) a horizontal longitudinally adjustable cantilever support bracket perpendicular to said wall with the rear end thereof detachably connected to said strut and adjustable in a vertical direction only to position said bracket at a selected one of a plurality of levels, (c) a sheet metal panel having front and rear faces and adapted to be positioned forwardly of said wall and normal to said bracket, and (d) horizontally extending channel means on the rear face of said panel cooperative with fastening means on the forward free end of said bracket for adjustably fixing said last-mentioned end to said panel at any predetermined point horizontally of said panel.

2. A construction as defined in claim 1, wherein said means on the rear face of said panel is a channel track extending longitudinally of the panel and said fastening means on said bracket comprises a slide member movable along said channel track.

3. A construction as defined in claim 1, including a plurality of additional sheet metal panels connected to the lateral edges of said first-mentioned panel, and quick detachable means connecting said panels to provide a unitary cornice structure.

4. A construction as defined in claim 1, wherein said sheet metal panel terminates in channels at the top and bottom thereof, extending rearwardly from the front of the panel, the channel at the top being of rectangular section with a horizontal reentrant flange having a free edge spaced from the rear face of said panel, a fluorescent light fixture comprising a horizontally extending base in a vertical plane terminating in a forwardly directed transverse flange along the bottom edge thereof and a U-shaped flange along the top thereof, with the outermost portion of the latter adapted to be supported by said reentrant flange engaged by rocking said base through the space between the channeled flange of the latter and the rear face of said sheet metal panel, while said transverse flange spaces the bottom of the base from said rear face.

5. A construction as set forth in claim 4, wherein said light fixture comprises fluorescent light means and reflector means for casting the principal light rays toward said wall.

6. A construction as in claim 4, wherein said means is a channel track extending longitudinally of the rear face of the panel adjacent the lower edge thereof and below said light fixture.

7. A construction as in claim 4, including a trim strip of rectangular cross-section with a gap at one corner thereof adapted to be snapped into engagement with the upper and lower channels along the top and bottom edges of said sheet metal panel.

8. A construction as defined in claim 7, including outwardly projecting prongs punched from said sheet metal panel for retaining the trim strips, the panel being partially encompassed within said gap.

9. A construction as in claim 3, wherein (a) adjacent panels are angularly disposed to define a corner, and (b) a corner member is detachably secured between said adjacent panels to provide an attractive finish at said corner.

10. A construction as in claim 1, wherein (a) said panel is spaced from a ceiling, and (b) an upswing panel member extends between and is detachably secured to said panel and ceiling, respectively.

11. A combination as in claim 9, wherein the corner member has portions coplanar with the respective panels and portions integral with said coplanar portions and extending to and detachably secured to a ceiling.

12. A construction as in claim 3, having (a) means detachably securing together a pair of adjacent panels in inconspicuous edge-to-edge abutting relation, comprising (b) angle means carried by each of said panels, each having flange parallel and secured to the inner face of a panel adjacent its free vertical edge and a flange normal thereto, and (c) means for detachably connecting together the respective normal flanges.

13. A construction as in claim 12, wherein said securing means comprises a slotted flange on each of said adjacent panels and cooperating removable fasteners extending through said slots.

14. In a knockdown light cornice construction for illuminating a retail store wall or the like, (a) a vertical strut adapted to be fixedly positioned adjacent said wall, (b) a horizontal longitudinally adjustable cantilever support bracket perpendicular to said wall with the rear end thereof detachably connected to said strut and adjustable in a vertical direction only to position said bracket at a selected one of a plurality of levels, (c) a sheet metal panel having front and rear faces and adapted to be positioned forwardly of said wall and normal to said bracket, and (d) cooperating female means on the rear face of said panel and male fastening means on the forward end of said bracket, for adjustably fixing said bracket to said panel at any predetermined point horizontally of said panel.

* * * * *